US011041385B2

(12) United States Patent
Nan et al.

(10) Patent No.: US 11,041,385 B2
(45) Date of Patent: Jun. 22, 2021

(54) MINING HYDRAULIC CONSTANT-RESISTANCE DEFORMING AND AUTOMATIC PRESSURE RELIEVING ANCHOR ROD AND WORKING METHOD THEREOF

(71) Applicant: HENAN POLYTECHNIC UNIVERSITY, Henan (CN)

(72) Inventors: Hua Nan, Henan (CN); Longfei Nan, Henan (CN); Yingming Wen, Henan (CN); Arshad Faizan, Henan (CN); Zhiqiang Han, Henan (CN)

(73) Assignee: HENAN POLYTECHNIC UNIVERSITY, Jiaozuo (CN)

( * ) Notice: Subject to any disclaimer, the term of this patent is extended or adjusted under 35 U.S.C. 154(b) by 0 days.

(21) Appl. No.: 17/039,132

(22) Filed: Sep. 30, 2020

(65) Prior Publication Data

US 2021/0017860 A1 Jan. 21, 2021

Related U.S. Application Data

(63) Continuation of application No. PCT/CN2019/121638, filed on Nov. 28, 2019.

(30) Foreign Application Priority Data

Jan. 21, 2019 (CN) ..... 201910052946.5

(51) Int. Cl.
*E21D 21/00* (2006.01)

(52) U.S. Cl.
CPC ..... *E21D 21/0046* (2013.01); *E21D 21/008* (2013.01); *E21D 21/0033* (2013.01)

(58) Field of Classification Search
CPC ..... E21D 21/0026; E21D 21/0046; E21D 21/0033; E21D 21/008; E21D 29/0093; E21D 20/02
See application file for complete search history.

(56) References Cited

U.S. PATENT DOCUMENTS 3,306,051 A * 2/1967 Howlett ..... E21D 20/02 405/259.5
3,403,594 A * 10/1968 Newell ..... E21D 21/008 411/344

(Continued)

FOREIGN PATENT DOCUMENTS

CN 102678147 A 9/2012
CN 104373146 A 2/2015

(Continued)

*Primary Examiner* — Benjamin F Fiorello

(57) ABSTRACT

An anchor rod includes a sleeve open at one end and having a blocking plate at the other end; a pressure relief pipe fixedly arranged on an inner wall of the sleeve; and a rod body. A guide hole is formed in a center of the blocking plate. A part of the rod body penetrates through the guide hole and extends into the sleeve. A gap is formed between the pressure relief pipe and the blocking plate. An overflow valve is connected to the pressure relief pipe. A piston in sliding seal fit with the sleeve and the pressure relief pipe is arranged at the rod body. A sealing ring in sliding seal fit with the rod body is arranged at the inner wall of the guide hole; and a sealing cavity between the blocking plate and the piston in the sleeve is filled with emulsion.

3 Claims, 4 Drawing Sheets

(56) References Cited

U.S. PATENT DOCUMENTS

| | | | | |
|---|---|---|---|---|
| 4,051,683 | A * | 10/1977 | Koval | E21D 20/025 405/259.6 |
| 5,112,160 | A * | 5/1992 | Jensen | E21D 21/008 405/259.1 |
| 2012/0112036 | A1* | 5/2012 | Sprague | G21C 15/25 248/674 |
| 2014/0099167 | A1* | 4/2014 | Zeitler | E21D 21/008 405/259.1 |
| 2014/0374166 | A1 | 12/2014 | Swope et al. | |
| 2015/0322785 | A1* | 11/2015 | Ahola | E21D 20/028 405/259.3 |
| 2018/0002885 | A1* | 1/2018 | Sun | H02S 20/10 |
| 2020/0181932 | A1* | 6/2020 | Gonzalez | E04H 12/2215 |

FOREIGN PATENT DOCUMENTS

| | | | |
|---|---|---|---|
| CN | 205089342 | U | 3/2016 |
| CN | 105781598 | A | 7/2016 |
| CN | 205422770 | U | 8/2016 |
| CN | 205778962 | U | 12/2016 |
| CN | 205778963 | U | 12/2016 |
| CN | 109184765 | A | 1/2019 |
| CN | 109736864 | A | 5/2019 |
| DE | 4332654 | A1 | 3/1995 |
| KR | 102019956 | B1 | 9/2019 |

* cited by examiner

MINING HYDRAULIC CONSTANT-RESISTANCE DEFORMING AND AUTOMATIC PRESSURE RELIEVING ANCHOR ROD AND WORKING METHOD THEREOF

TECHNICAL FIELD

The present invention belongs to the technical field of anchor rod support, and particularly relates to a mining hydraulic constant-resistance deforming and automatic pressure relieving anchor rod and a working method thereof.

BACKGROUND OF THE PRESENT INVENTION

Since the first use of anchor rods to support underground roadways in the Siletz Mine in Germany in 1912, the anchor rod support has been widely used in civil engineering (including mining engineering) due to the characteristics of simple structure, convenient construction, low cost and strong adaptability to the engineering. However, the deformation of the surrounding rock of the roadway tolerable to the traditional rigid anchor rod is generally less than 200 mm, and thus the traditional rigid anchor rod may be snapped and fail due to inadaptability to the large deformation of the surrounding rock of the roadway.

SUMMARY OF THE PRESENT INVENTION

To solve the deficiencies in the prior art, the present invention provides a mining hydraulic constant-resistance deforming and automatic pressure relieving anchor rod and a working method thereof, wherein the anchor rod adopts the hydraulic technology and has strong tensile capacity, good pressure relief capacity and high supporting strength.

To solve the above technical problems, the following technical solution is adopted in the present invention: a mining hydraulic constant-resistance deforming and automatic pressure relieving anchor rod includes a sleeve, a pressure relief pipe and a rod body which are arranged in the left-right direction, wherein a left end of the sleeve is open; a blocking plate is arranged at a right end of the sleeve; a guide hole is formed in the center of the blocking plate; a left part of the rod body penetrates through the guide hole and extends into the sleeve; the pressure relief pipe is fixedly arranged on an inner wall of the sleeve in a length direction of the sleeve; a gap is formed between a right end of the pressure relief pipe and a left side of the blocking plate; an overflow valve is connected to a left end of the pressure relief pipe; a piston in sliding sealing fit with the inner wall of the sleeve and an outer wall of the pressure relief pipe is arranged at a left end of the rod body; a sealing ring in sliding sealing fit with an outer circumference of the left part of the rod body is arranged at the inner wall of the guide hole in the blocking plate; and a sealing cavity formed between the blocking plate and the piston in the sleeve is filled with emulsion.

The outer circumference of the left end of the sleeve is provided with an external thread; a tray is sleeved on the left side of the sleeve; and a nut for pressing the left side of the tray is in threaded connection with the external thread.

The right part of the rod bod is located at the right side of the blocking plate; the diameter of the right part of the rod body is greater than that of the left part of the rod body; and the left end of the right part of the rod body is in coaxial threaded connection with the right end of the left part of the rod body.

The piston and the left part of the rod body are integrally formed by casting; an annular groove is arranged around the rod body at the right side of the piston; and a cross section of the annular groove is a curved surface structure with an opened right end.

A working method of the mining hydraulic constant-resistance deforming and automatic pressure relieving anchor rod includes the following steps:

(1) welding the pressure relief pipe to the inner wall of the sleeve first, then placing the integrally casted piston and left part of the rod body into the sleeve, forming one groove in the outer circumference of the piston in advance to realize the sliding sealing fit between the piston and the pressure relief pipe, mounting the overflow valve at the left end of the pressure relief pipe, making the left part of the rod body extend out of the blocking plate to the right after penetrating through the guide hole in the blocking plate, and allowing the right end of the left part of the rod body to be in threaded connection with the left end of the right part of the rod body;

(2) injecting the emulsion into the sleeve through the overflow valve and the pressure relief pipe, and stopping injection after the sealing cavity between the sleeve and the left part of the rod body is filled with the emulsion;

(3) driving the anchor rod into a drill hole by using an anchor rod machine, anchoring one section at the right end of the right part of the anchor rod onto an inner end of the drill hole by an anchoring agent, mounting the tray, and screwing the nut on the left end of a casing;

(4) when the anchor rod bears tensile stress during supporting, moving the rod body to the right to pull the piston to move to the right, converting the borne tensile stress into compressive stress on the emulsion by the piston, and gradually discharging the emulsion from the pressure relief pipe through the overflow valve during pressure bearing, wherein the deformation of the anchor rod is equal to the length of the sleeve plus the deformation of the rod body; and the complete constant-resistance deformation is realized in the whole hydraulic process, thereby ensuring the bearing capacity of the anchor rod to various stress forms.

By adopting the above technical solution, the rod body is formed by the threaded connection of the left part and the right part with different outer diameters, which is not only convenient to manufacture, but also convenient to mount; more importantly, the left end of the right part of the rod body is in ejecting contact with the right side of the blocking plate to prevent the piston from moving to the left in the sleeve.

The piston and the left part of the rod body are integrally formed by casting, which improves the strength of the two structures and avoids damage to the structures due to separation of the piston and the rod body during tension bearing.

The annular groove is arranged around the rod body at the right side of the piston; and a cross section of the annular groove is a curved surface structure with an opened right end, so that the conversion of tension and compression stress can be realized completely, and a stress concentration phenomenon of compression stress at a joint can also be reduced.

In conclusion, the constant-resistance deformation of the anchor rod is realized by using the hydraulic technology according to the present invention; and the tensile capacity of the anchor rod and the coping capacity for a series of problems such as high stress and high osmotic pressure faced by deep mining are greatly enhanced, thereby ensuring that the anchor rod still has a strong supporting effect under complex conditions such as high stress and high osmotic pressure in deep mining and truly realizing the constant-resistance pressure relief of the anchor rod.

DETAILED DESCRIPTION OF THE PRESENT INVENTION

Figure 1:
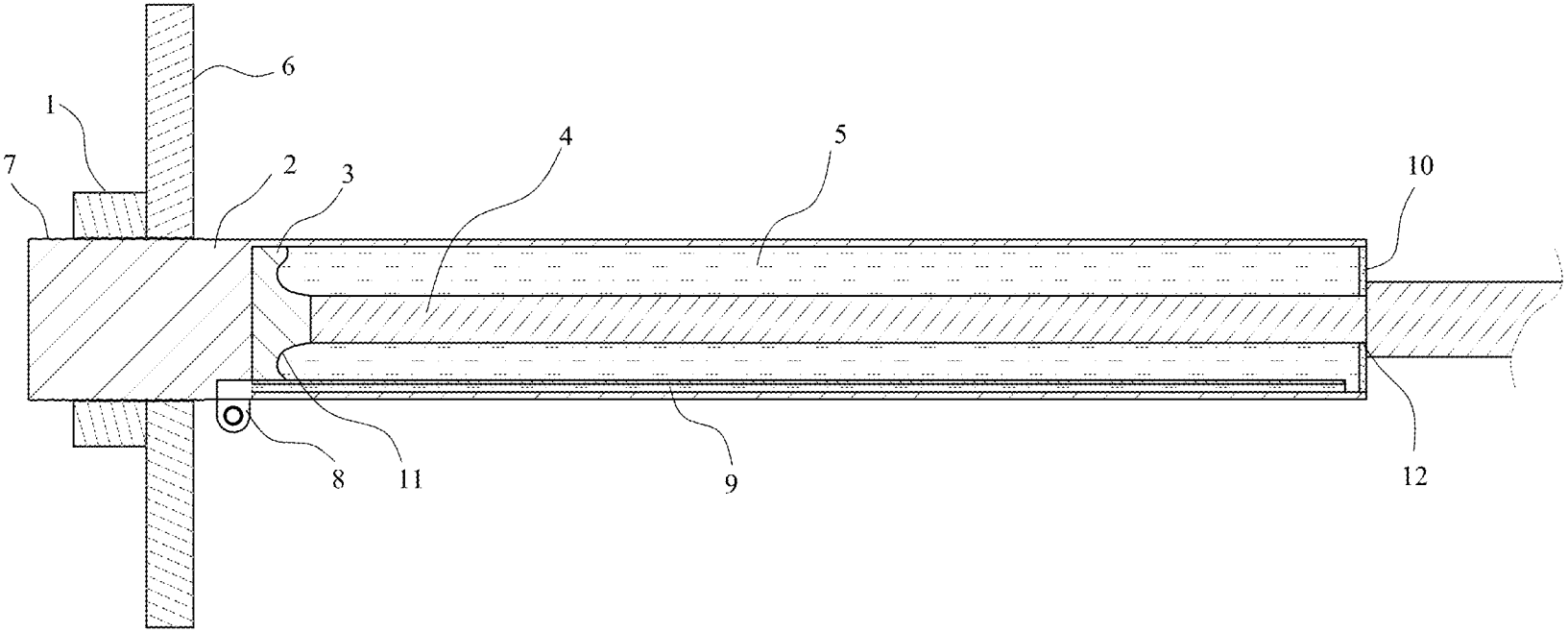
FIG. 1 is a structural schematic diagram of the present invention.
Figure 2:
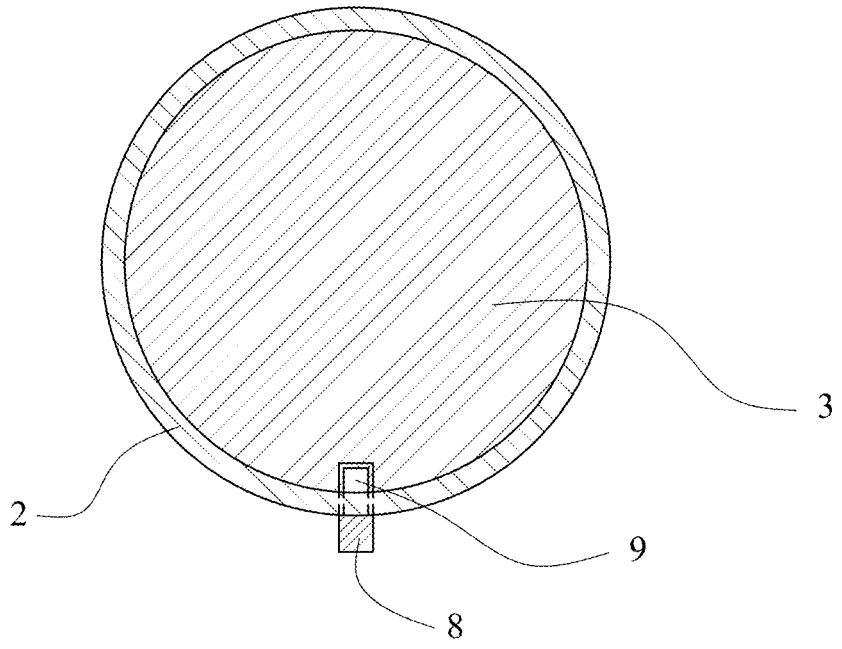
FIG. 2 is a schematic diagram of a cross section of an outer circumference of a piston matched with an inner wall of a sleeve and an outer wall of a pressure relief pipe.

As shown in FIG. 1 and FIG. 2, a mining hydraulic constant-resistance deforming and automatic pressure relieving anchor rod of the present invention includes a sleeve 2, a pressure relief pipe 9 and a rod body 4 which are arranged in the left-right direction. A left end of the sleeve 2 is open; a blocking plate 10 is arranged at a right end of the sleeve 2; a guide hole is formed in the center of the blocking plate 10; a left part of the rod body 4 penetrates through the guide hole and extends into the sleeve 2; the pressure relief pipe 9 is fixedly arranged on an inner wall of the sleeve 2 in a length direction of the sleeve 2; a gap is formed between a right end of the pressure relief pipe 9 and a left side of the blocking plate 10; an overflow valve 8 is connected to a left end of the pressure relief pipe 9; a piston 3 in sliding sealing fit with the inner wall of the sleeve 2 and an outer wall of the pressure relief pipe 9 is arranged at a left end of the rod body 4; a sealing ring in sliding sealing fit with an outer circumference of the left part of the rod body 4 is arranged at the inner wall 12 of the guide hole in the blocking plate 10; and a sealing cavity formed between the blocking plate 10 and the piston 3 in the sleeve 2 is filled with emulsion 5.

The outer circumference of the left end of the sleeve 2 is provided with an external thread 7; a tray 6 is sleeved on the left side of the sleeve 2; and a nut 1 for pressing the left side of the tray 6 is in threaded connection with the external thread 7.

The right part of the rod bod 4 is located at the right side of the blocking plate 10; the diameter of the right part of the rod body 4 is greater than that of the left part of the rod body 4; and the left end of the right part of the rod body 4 is in coaxial threaded connection with the right end of the left part of the rod body 4.

The piston 3 and the left part of the rod body 4 are integrally formed by casting; an annular groove 11 is arranged around the rod body 4 at the right side of the piston 3; and a cross section of the annular groove 11 is a curved surface structure with an opened right end.

Figure 3:
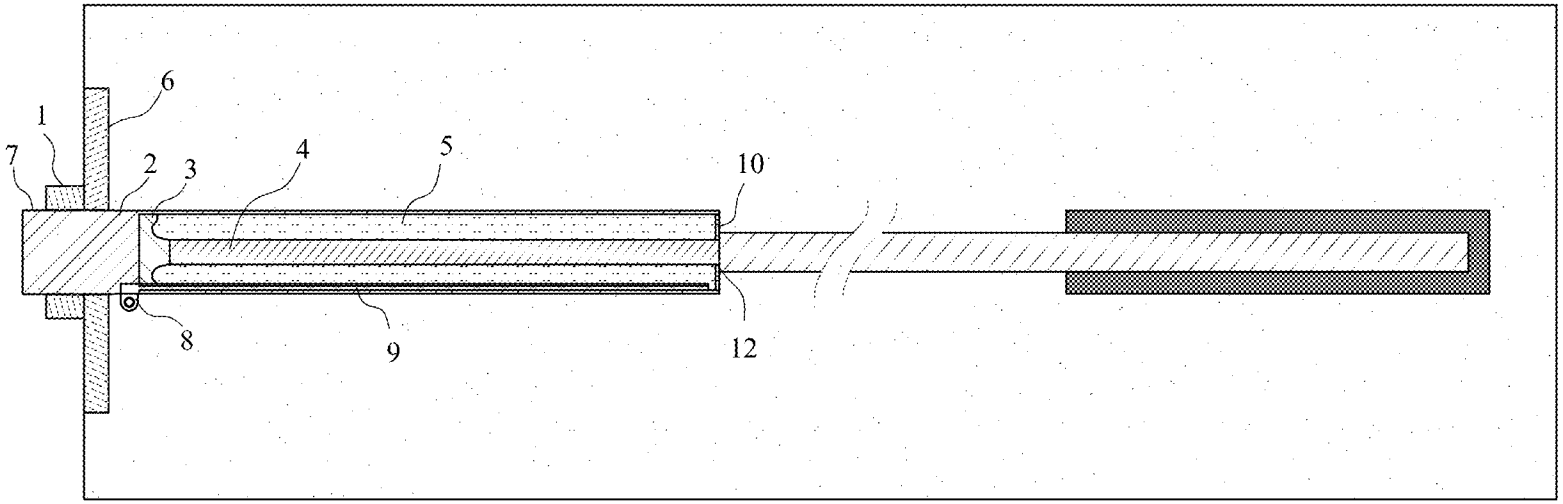
FIG. 3 is a schematic diagram of the present invention at an initial stage of being driven into a drill hole for supporting.
Figure 4:
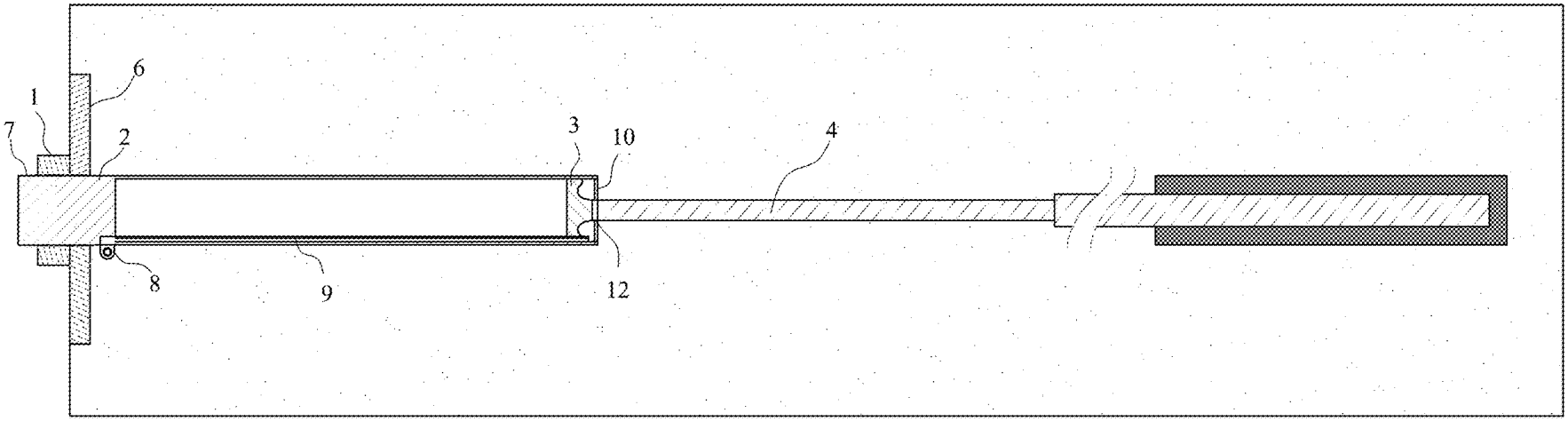
FIG. 4 is a schematic diagram of the present invention at a constant-resistance deformation stage during supporting.

A working method of the mining hydraulic constant-resistance deforming and automatic pressure relieving anchor rod includes the following steps:

(1) welding the pressure relief pipe 9 to the inner wall of the sleeve 2 first, then placing the integrally casted piston 3 and left part of the rod body 4 into the sleeve 2, forming one groove in the outer circumference of the piston 3 in advance to realize the sliding sealing fit between the piston 3 and the pressure relief pipe 9, mounting the overflow valve 8 at the left end of the pressure relief pipe 9, making the left part of the rod body 4 extend out of the blocking plate 10 to the right after penetrating through the guide hole in the blocking plate 10, and allowing the right end of the left part of the rod body 4 to be in threaded connection with the left end of the right part of the rod body 4;

(2) injecting the emulsion 5 into the sleeve 2 through the overflow valve 8 and the pressure relief pipe 9, and stopping injection after the sealing cavity between the sleeve 2 and the left part of the rod body 4 is filled with the emulsion 5;

(3) driving the anchor rod into a drill hole by using an anchor rod machine, anchoring one section at the right end of the right part of the anchor rod onto an inner end of the drill hole by an anchoring agent, mounting the tray 6, and screwing the nut 1 on the left end of a casing, as shown in FIG. 3;

(4) when the anchor rod bears tensile stress during supporting, moving the rod body 4 to the right to pull the piston 3 to move to the right, converting the borne tensile stress into compressive stress on the emulsion 5 by the piston 3, and gradually discharging the emulsion 5 from the pressure relief pipe 9 through the overflow valve 8 during pressure bearing, wherein the deformation of the anchor rod is equal to the length of the sleeve 2 plus the deformation of the rod body 4; and the complete constant-resistance deformation is realized in the whole hydraulic process, thereby ensuring the bearing capacity of the anchor rod to various stress forms, as shown in FIG. 4.

The present embodiment does not limit the shape, material and structure of the present invention in any form. Any simple amendment, equivalent change and modification made to the above embodiment according to the technical essence of the present invention shall fall within the protection scope of the technical solution of the present invention.

We claim:

1. A mining hydraulic constant-resistance deforming and automatic pressure relieving anchor rod, comprising a sleeve, a pressure relief pipe and a rod body which are arranged in a left-right direction, wherein a left end of the sleeve is open; a blocking plate is arranged at a right end of the sleeve; a guide hole is formed in the center of the blocking plate; a left part of the rod body penetrates through the guide hole and extends into the sleeve; the pressure relief pipe is fixedly arranged on an inner wall of the sleeve in a length direction of the sleeve; a gap is formed between a right end of the pressure relief pipe and a left side of the blocking plate; an overflow valve is connected to a left end of the pressure relief pipe; a piston in sliding sealing fit with the inner wall of the sleeve and an outer wall of the pressure relief pipe is arranged at a left end of the rod body; a sealing ring in sliding sealing fit with an outer circumference of the left part of the rod body is arranged at the inner wall of the guide hole in the blocking plate; and a sealing cavity formed between the blocking plate and the piston in the sleeve is filled with emulsion;

the right part of the rod body is located at the right side of the blocking plate; the diameter of the right part of the rod body is greater than the diameter of the left part of the rod body; and the left end of the right part of the rod body is in coaxial threaded connection with the right end of the left part of the rod body;

the piston and the left part of the rod body are integrally formed by casting; an annular groove is arranged around the rod body at the right side of the piston; and a cross section of the annular groove is a curved surface structure with an opened right end.

2. The mining hydraulic constant-resistance deforming and automatic pressure relieving anchor rod according to claim 1, wherein the outer circumference of the left end of the sleeve is provided with an external thread; a tray is sleeved on the left side of the sleeve; and a nut for pressing the left side of the tray is in threaded connection with the external thread.

3. A working method of the mining hydraulic constant-resistance deforming and automatic pressure relieving anchor rod of claim 2, comprising the following steps:

(1) welding the pressure relief pipe to the inner wall of the sleeve first, then placing the integrally casted piston and left part of the rod body into the sleeve, forming one groove in the outer circumference of the piston in advance to realize the sliding sealing fit between the piston and the pressure relief pipe, mounting the overflow valve at the left end of the pressure relief pipe, making the left part of the rod body extend out of the blocking plate to the right after penetrating through the guide hole in the blocking plate, and allowing the right end of the left part of the rod body to be in threaded connection with the left end of the right part of the rod body;

(2) injecting the emulsion into the sleeve through the overflow valve and the pressure relief pipe, and stopping injection after the sealing cavity between the sleeve and the left part of the rod body is filled with the emulsion;

(3) driving the anchor rod into a drill hole by using an anchor rod machine, anchoring one section at the right end of the right part of the anchor rod onto an inner end of the drill hole by an anchoring agent, mounting the tray, and screwing the nut on the left end of a casing;

(4) when the anchor rod bears tensile stress during supporting, moving the rod body to the right to pull the piston to move to the right, converting the borne tensile stress into compressive stress on the emulsion by the piston, and gradually discharging the emulsion from the pressure relief pipe through the overflow valve during pressure bearing, wherein the deformation of the anchor rod is equal to the length of the sleeve plus the deformation of the rod body; and the complete constant-resistance deformation is realized in the whole hydraulic process, thereby ensuring the bearing capacity of the anchor rod to various stress forms.

* * * * *